US009689773B2

(12) United States Patent
Kim et al.

(10) Patent No.: US 9,689,773 B2
(45) Date of Patent: Jun. 27, 2017

(54) METHOD FOR DIAGNOSING ABRASION OF ELECTRIC OIL PUMP ROTOR

(71) Applicants: Hyundai Motor Company, Seoul (KR); KIA MOTORS CORP., Seoul (KR)

(72) Inventors: Gyeong Cheol Kim, Hwaseong-si (KR); Hak Sung Lee, Gunpo-si (KR); Seong Hwan Kim, Hwaseong-si (KR); Sang Lok Song, Hwaseong-si (KR)

(73) Assignees: HYUNDAI MOTOR COMPANY, Seoul (KR); KIA MOTORS CORPORATION, Seoul (KR)

( * ) Notice: Subject to any disclaimer, the term of this patent is extended or adjusted under 35 U.S.C. 154(b) by 89 days.

(21) Appl. No.: 14/933,861

(22) Filed: Nov. 5, 2015

(65) Prior Publication Data

US 2017/0003206 A1 Jan. 5, 2017

(30) Foreign Application Priority Data

Jul. 1, 2015 (KR) ..... 10-2015-0094087

(51) Int. Cl.

| | |
|---|---|
| ***G01M 13/00*** | (2006.01) |
| ***F01M 1/02*** | (2006.01) |
| ***F01M 1/18*** | (2006.01) |
| ***F01M 11/10*** | (2006.01) |

(52) U.S. Cl.

CPC ..... *G01M 13/00* (2013.01); *F01M 1/02* (2013.01); *F01M 1/18* (2013.01); *F01M 11/10* (2013.01); *F01M 2001/0215* (2013.01); *F01M 2001/0238* (2013.01)

(58) Field of Classification Search

None

See application file for complete search history.

(56) References Cited

U.S. PATENT DOCUMENTS

| | | | | |
|---|---|---|---|---|
| 2006/0272869 | A1* | 12/2006 | Hidaka | B60K 6/48 180/65.25 |
| 2011/0033317 | A1 | 2/2011 | Greven et al. | |
| 2013/0073174 | A1* | 3/2013 | Worden | F02D 41/22 701/102 |

FOREIGN PATENT DOCUMENTS

| | | | |
|---|---|---|---|
| EP | 0851127 | A2 | 7/1998 |
| JP | 2000-274378 | A | 10/2000 |
| JP | 2001-065487 | A | 3/2001 |
| KR | 10-2010-0003027 | A | 1/2010 |

OTHER PUBLICATIONS

Korean Office Action dated Dec. 21, 2016, issued in Korean patent application No. 10-2015-0094087.

* cited by examiner

*Primary Examiner* — Andre Allen

(74) *Attorney, Agent, or Firm* — McDermott Will & Emery LLP

(57) ABSTRACT

A method for diagnosing abrasion of an electric oil pump rotor includes sensing a driving duty of an oil pump control unit, and determining whether the sensed driving duty of the oil pump control unit is below a set reference value, wherein as a result of the determining, when the driving duty of the oil pump control unit is below the set reference value, it is determined that the electric oil pump rotor is in a worn out state.

9 Claims, 3 Drawing Sheets

METHOD FOR DIAGNOSING ABRASION OF ELECTRIC OIL PUMP ROTOR

CROSS-REFERENCE TO RELATED APPLICATION

The present application claims the benefit of priority to Korean Patent Application No. 10-2015-0094087, filed Jul. 1, 2015 with the Korean Intellectual Property Office, the entire contents of which is incorporated herein by reference.

TECHNICAL FIELD

The present disclosure relates to a method for diagnosing abrasion of an electric oil pump rotor.

BACKGROUND

Recently, interest in hybrid vehicles with improved fuel efficiency has been increasing. Such hybrid vehicles generally have an electric oil pump (hereinafter, referred to as "EOP") for supplying a working fluid required for actuating a transmission and a clutch which are interposed between an engine and an actuating motor. Further, the hybrid vehicles generally have an oil pump control unit (hereinafter, referred to as "OPU") for controlling the electric oil pump operation.

The EOP generates hydraulic pressure by rotating a rotor therein using a driving force of a motor and pumping transmission fluid (ATF) to the transmission. However, when the rotor of EOP is abraded, a proper hydraulic pressure is not generated in the transmission such that the performance of the transmission is decreased. In such a case, the pump needs to be replaced.

Generally, according to a prior art, a system where the EOP and a mechanical oil pump (MOP) are coupled has been used. In such a case, the abrasion situation of the electric oil pump rotor can be diagnosed by measuring and noting that the amount of current consumed when the electric oil pump rotor is worn out is lower than the amount of current consumed when the electric oil pump rotor is normal.

However, often the mechanical oil pump is deleted in order to improve fuel efficiency in an automatic transmission of the hybrid vehicles, and a method for supplying oil by optimally controlling a flow rate by means of only the EOP has been adopted. In other words, the mechanical oil pump which is an oil supply module of a general automatic transmission is deleted in the automatic transmission of the hybrid vehicles, the EOP which is actuated when more than 40V of high voltage, is applied in order to supply a sufficient flow rate. As a result, the amount of current consumed by the EOP decreases, and thus there is a problem in that the prior method for diagnosing abrasion of the electric oil pump rotor based on the amount of current becomes inaccurate.

The description provided above described as a related art is just for helping in understanding the background of the present disclosure and should not be construed as being included in the related art known by those skilled in the art.

SUMMARY

It is an object of the present disclosure to provide a method for diagnosing abrasion of an electric oil pump rotor capable of accurately diagnosing the abrasion state of the electric oil pump rotor using a driving duty of an oil pump control unit.

In one aspect, the present disclosure provides a method for diagnosing abrasion of an electric oil pump rotor includes a step of diagnosing the electric oil pump rotor using a driving duty of the oil pump control unit.

The step of diagnosing includes a step of sensing a driving duty of an oil pump control unit; a step of determining whether the sensed driving duty of the oil pump control unit is less than a set reference value; and a step of determining, by the controller, the electric oil pump rotor is in a worn out state, when the sensed driving duty of the oil pump control unit is less than the set reference value.

As a result of the determining step, the method may include a step of outputting a warning signal when the driving duty of the oil pump control unit is below the set reference value.

The method may further include, before the diagnosing step, a step of confirming whether it is possible to perform the diagnosing, wherein as a result of the confirming step, when it is possible to perform the diagnosing, the sensing step is performed.

The confirming step may include determining whether a voltage inputted into the OPU is included in a preset region, and the diagnosing is not performed when the voltage is not included in the preset region.

The confirming step may includes determining whether a temperature of an automatic transmission fluid is below a predetermined temperature, and the diagnosing is not performed when the temperature of the automatic transmission fluid is below the predetermined temperature.

The confirming step may include determining whether a temperature sensor for sensing a temperature of an automatic transmission fluid is operable, and the diagnosing is not performed when the temperature sensor is inoperable.

The confirming step, when may include determining whether the number of revolutions of the EOP is included in a set number of revolution, and the diagnosing is not performed when the number of revolutions of the EOP is not included in the set number of revolutions.

The confirming step may include determining whether other diagnostic counts are generated in the OPU, and the diagnosing is not performed when other diagnostic counts are generated.

The step of determining whether the sensed driving duty of the oil pump control unit is below a set reference value may determine whether the driving duty of the oil pump control unit is less than a set driving duty region, and the outputting step may output a warning signal when the driving duty of the oil pump control unit is less than the set driving duty region.

It is understood that the term "vehicle" or "vehicular" or other similar term as used herein is inclusive of motor vehicles in general such as passenger automobiles including sports utility vehicles (SUV), buses, trucks, various commercial vehicles, watercraft including a variety of boats and ships, aircraft, and the like, and includes hybrid vehicles, electric vehicles, plug-in hybrid electric vehicles, hydrogen-powered vehicles and other alternative fuel vehicles (e.g. fuels derived from resources other than petroleum). As referred to herein, a hybrid vehicle is a vehicle that has two or more sources of power, for example both gasoline-powered and electric-powered vehicles.

BRIEF DESCRIPTION OF THE DRAWINGS

The above and other features of the present disclosure will now be described in detail with reference to exemplary embodiments thereof illustrating the accompanying drawings which are given herein below by way of illustration only, and thus are not limitative of the present disclosure, and wherein.

Figure 1:
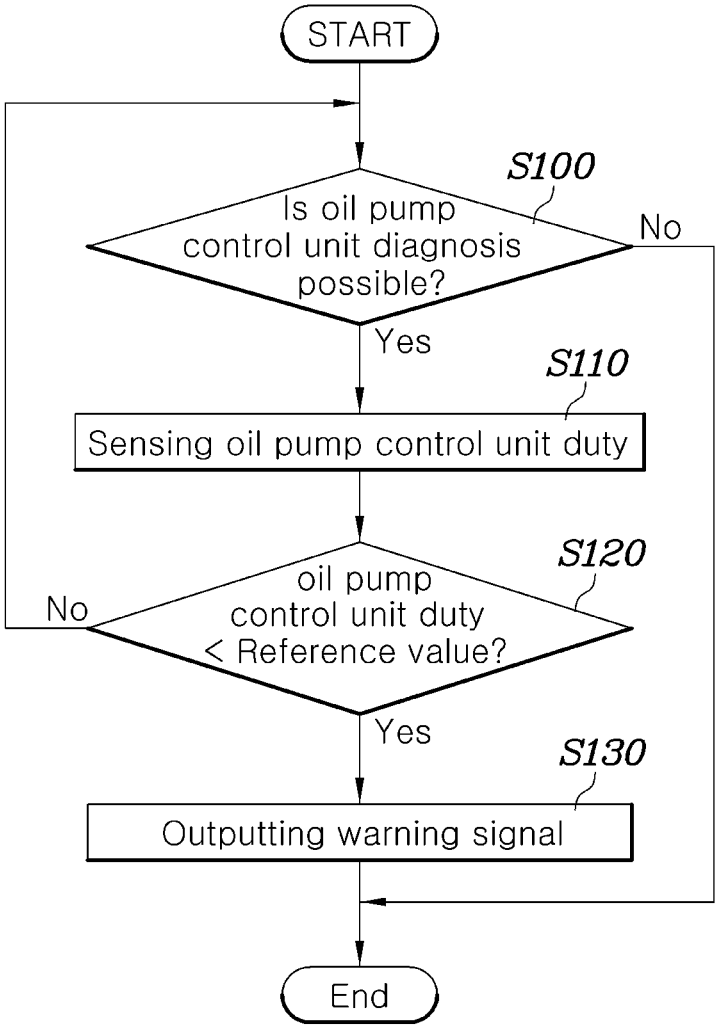
FIG. 1 is a flow chart illustrating a method for diagnosing abrasion of an electric oil pump rotor according to an embodiment of the present disclosure.

It should be understood that the appended drawings are not necessarily to scale, presenting a somewhat simplified representation of various preferred features of the present disclosure as disclosed herein, including, for example, specific dimensions, orientations, locations, and shapes will be determined in part by the particular intended application and use environment.

In the figures, reference numbers refer to the same or equivalent parts of the present disclosure throughout the several figures of the drawing.

DETAILED DESCRIPTION

Hereinafter reference will now be made in detail to various embodiments of the present disclosure, examples of which are illustrated in the accompanying drawings and described below. While the disclosure will be described in conjunction with exemplary embodiments, it will be understood that the present description is not intended to limit the disclosure to those exemplary embodiments. On the contrary, the disclosure is intended to cover the exemplary embodiments as well as various alternatives, modifications, equivalents and other embodiments; which may be included in the spirit and scope of the disclosure as defined by the appended claims.

Hereinafter a method for diagnosing abrasion of an electric oil pump rotor according to the preferred embodiment of the present disclosure is described with reference to drawings attached.

Figure 2:
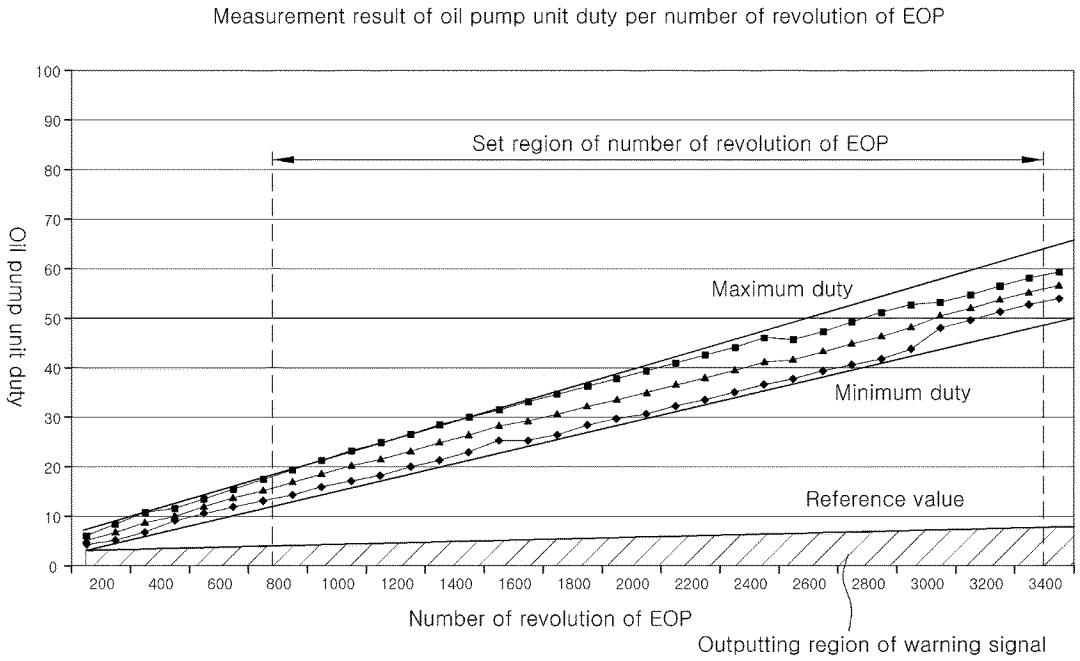
FIG. 2 is a graph illustrating ratios of a number of a revolution of the EOP to the driving duty of the oil pump control unit value according to an embodiment of the present disclosure.
Figure 3:
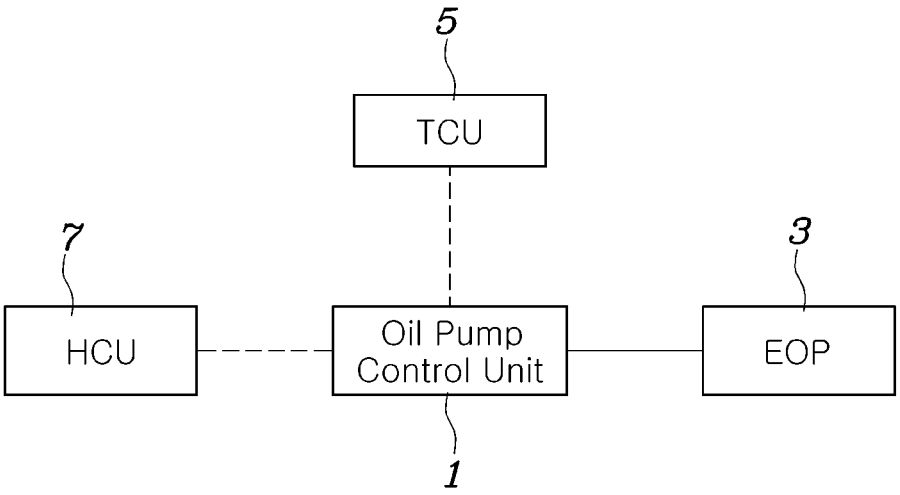
FIG. 3 is a block diagram illustrating an apparatus of diagnosing abrasion of an electric oil pump rotor according to an embodiment of the present disclosure.

FIG. 1 is a flow chart illustrating a method for diagnosing abrasion of an electric oil pump rotor according to an embodiment of the present disclosure, FIG. 2 is a graph illustrating ratios of a number of a revolution of the EOP to the driving duty of the oil pump control unit value according to an embodiment of the present disclosure, and FIG. 3 is a block diagram illustrating an apparatus of diagnosing abrasion of an electric oil pump rotor according to an embodiment of the present disclosure. Referring to FIGS. 1 to 3, a method for diagnosing abrasion of an electric oil pump rotor may include sensing a driving duty of an oil pump control unit 1 S110; and determining whether the sensed driving duty of the oil pump control unit is less than a preset reference value S120, wherein as a result of the determining, when the driving duty of the oil pump control unit is less than the preset reference value, it is determined that the electric oil pump rotor is in a worn out state.

Conventionally, since the mechanical oil pump (hereinafter referred to as "MOP") and the EOP are provided as a coupled system, sufficient oil pressure may have been supplied to an automatic transmission even though the EOP is actuated with low voltage.

However, since the MOP is removed to improve fuel efficiency and the EOP has to be actuated with high voltage in order to provide flow rate only by the EOP, current consumption becomes relatively very low. As such, as the current consumed for actuating the EOP becomes low, the accuracy of the abrasion diagnosis of the EOP using current value is decreased. Accordingly, the present disclosure describes that the abrasion of the EOP is diagnosed based on the driving duty of the oil pump control unit rather than the amount of current consumed in order to actuate the EOP. The abrasion diagnosis of the electric oil pump rotor based on the driving duty of the oil pump control unit is performed using a transmission control unit (TCU) 5 or a hybrid control unit (HCU) 7 which is a high rank controller of the OPU 1, or the OPU itself. The TCU 5, the HCU 7 and the OPU 1 can be referred to as a controller.

The driving duty of the oil pump control unit 1 may be a control characteristic value which indicates generally an actuating amount and an actuating frequency required for actuating the EOP by the OPU for a predetermined period of time. For example, assuming that the number of revolution required of the EOP 3 increases, the OPU actuates the EOP 3 faster or more frequently than before so that the EOP 3 actuates with the number of faster revolution and thus the driving duty of the oil pump control unit 1 increases. In contrast, when the number of revolution required of the EOP 3 decreases, the OPU 1 actuates less than before and thus the driving duty of the oil pump control unit 1 decreases. However, this is an example of changes in the driving duty of the oil pump control unit when the EOP 3 is in a load condition as a normal state in which the electric oil pump rotor is not worn out.

If abrasion of the electric oil pump rotor occurs, the EOP 3 performs no-load actuation such as an idle actuation since load is not generated and thereby the amount of the current consumed in order to actuate the EOP 3 becomes a very small value. Since this case is the state where load is not applied to the EOP 3, the driving duty of the oil pump control unit of a normal state corresponding to the number of revolutions required to the EOP 3 may not be formed. The driving duty of the oil pump control unit 1 in the state where the electric oil pump rotor is worn out is formed smaller than the driving duty of the oil pump control unit 1 in the normal state.

The present disclosure is capable of diagnosing abrasion of the electric oil pump rotor more precisely than the conventional diagnosis method which uses current consumed by performing the diagnosis of the abrasion of the electric oil pump rotor based on changes in the driving duty of the oil pump control unit 1.

Additionally, as a result of the determining S120, when the driving duty of the oil pump control unit is less than the reference value, the method may include outputting a warning signal S130.

The reference value may be set to be the driving duty of the oil pump control unit at the time of determining when the EOP does not smoothly provide oil pressure to the automatic transmission due to abrasion of the electric oil pump rotor, but the specific value may be variable according to a vehicle and a designer.

For example, referring to FIG. 2, when the driving duty of the oil pump control unit 1 is included in the outputting region of the warning signal that is smaller than the reference value, the EOP 3 is actuated with a no-load condition, wherein it is determined that abrasion of the engine oil pump rotor has occurred, thereby outputting a warning signal which demands a replacement of the EOP 3 S130. In contrast, when the driving duty of the oil pump control unit is greater than the reference value, it is determined that abrasion of the electric oil pump rotor has not occurred, thereby normally actuating the EOP 3 and again being capable of sensing the driving duty of the oil pump control unit 1.

The warning signal may be output to a display device or an audio device, thereby allowing a driver or a repair person to recognize a replacement of the electric oil pump rotor.

Meanwhile, the present disclosure further includes before the sensing S110, confirming whether an oil pump control unit diagnosis is possible S100, wherein as a result of the confirming S100, when the oil pump control unit diagnosis is possible, the sensing S110 is performed.

According to the present disclosure, it is possible to reduce a phenomenon of increasing repair costs incurred due to misdiagnosis of the abrasion state of the electric oil pump rotor, which is performed by the OPU 1, by confirming whether the oil pump control unit diagnosis is possible before the abrasion diagnosis of the electric oil pump rotor is performed using the driving duty of the oil pump control unit 1, in the condition where correct diagnosis is possible.

Specifically, the cases where diagnosis of the abrasion state of the electric oil pump rotor through the OPU 1 is impossible are as follows. First, at the time of confirming S100, when the voltage inputted into the OPU 1 is not included in the preset region, it may determine that the oil pump control unit diagnosis is impossible and terminates the control. In this case, the preset region may be any voltage region within which it is determined that the abrasion of the electric oil pump rotor is clearly diagnosed using the driving duty of the oil pump control unit by stably supplying the voltage inputted into the OPU 1. When the voltage inputted into OPU 1 is less than the preset region, since the driving duty of the oil pump control unit 1 measured is small, the abrasion diagnosis of the electric oil pump rotor based on the driving duty of the oil pump control unit 1 may not be accurate.

Accordingly, in case of hybrid vehicles, when the voltage inputted into the OPU 1 is within the region from more than 230V to less than 300V, it is determined that the abrasion diagnosis of the electric oil pump rotor is accurate and thereby the driving duty of the oil pump control unit 1 may be sensed. In addition, in the case of plug-in hybrid vehicles, when the voltage inputted into the OPU 1 is within the region from more than 320 V to less than 390V, it is determined that the abrasion diagnosis of the EOP 3 is accurate and thereby the driving duty of the oil pump control unit may be sensed. However, this is only a set voltage regions as an embodiment and may be set to be varied according to the vehicle and the designer.

Further, at the time of confirming S100, when the temperature of an automatic transmission fluid (ATF) is less than a predetermined temperature, or when a temperature sensor for sensing the temperature of the automatic transmission fluid is broken, it is determined that the oil pump control unit diagnosis is unable to terminate the control.

This is intended to perform the abrasion diagnosis of the electric oil pump rotor, only when the automatic transmission fluid pumped into the automatic transmission continues to maintain a predetermined temperature or more. In other words, in a case such as winter, the temperature of the automatic transmission fluid may become less than 0° C. and in this case the abrasion diagnosis of the electric oil pump rotor based on the driving duty of the oil pump control unit 1 is not accurate, and thus the abrasion diagnosis logic is not performed. Further, when the temperature sensor is broken, the temperature of the automatic transmission fluid may not be grasped and accordingly the reliability of the driving duty of the oil pump control unit 1 is reduced, and thus the abrasion diagnosis logic is not performed.

Further, at the time of confirming S100, when the number of revolutions of the EOP 3 is not included in a set region thereof, it is determined that the oil pump control unit diagnosis is unable to terminate the control. This is to perform the rotor abrasion diagnosis after confirming that the EOP 3 is actuated with the number of the revolutions through which it may be determined that EOP 3 is actually actuated. For example when the number of the revolution of the EOP 3 is less than the set region thereof, it is determined that the EOP 3 is not actuated so as not to diagnose the abrasion state of the electric oil pump rotor which is not actuated, thereby preventing energy consumption due to unnecessary control.

Finally, at the time of confirming S100, when other diagnostic count occurs in the OPU 1, it is determined that the oil pump control unit diagnosis is unable to terminate the control. In other words, when other control logic is being performed by the OPU 1, since the driving duty of the oil pump control unit 1 may be uncertainly sensed, the abrasion state of electric oil pump rotor may not be diagnosed.

Only when satisfying the abrasion diagnosis condition described above, the abrasion diagnosis of the electric oil pump rotor is performed, thereby preventing losses by misdiagnosis.

Meanwhile, according to the present disclosure, it is determined whether the driving duty of the oil pump control unit is less than a set driving duty region in the determining step S120, and when the driving duty of the oil pump control unit is less than the set driving duty region, the warning signal is output in the outputting step S130.

Referring to FIG. 2, when the driving duty of the oil pump control unit 1 is included in a normal driving duty region between a maximum driving duty and a minimum driving duty that are each set according to the number of revolutions of the EOP 3, the electric oil pump rotor may be diagnosed as a best state. When the electric oil pump rotor is worn out, the driving duty of the oil pump control unit 1 is less than the normal driving duty region, wherein the present disclosure may designate the region of values obtained by multiplying the normal driving duty region by 0.2 as the set driving duty region. However, this is only a driving duty region set according to an embodiment, and thus may be variably set according to the vehicle and the designer.

According to a method for diagnosing abrasion of an electric oil pump rotor having a structure described above, the abrasion of the electric oil pump rotor actuated by high voltage may be accurately diagnosed by using the driving duty of the oil pump control unit 1.

Further, according to the present disclosure, the misdiagnosing of the abrasion condition of the electric oil pump rotor may be prevented by confirming whether the OPU 1 may perform the abrasion diagnosis before the abrasion condition of the electric oil pump rotor is diagnosed.

The disclosure has been described in detail with reference to preferred embodiments thereof. However, it will be appreciated by those skilled in the art that changes may be made in these embodiments without departing from the principles and spirit of the disclosure, the scope of which is defined in the appended claims and their equivalents.

What is claimed is:

1. A method for diagnosing abrasion of an electric oil pump rotor, comprising:

diagnosing the electric oil pump rotor using a driving duty of the oil pump control unit, wherein the diagnosing includes:

sensing, by a controller, a driving duty of an oil pump control unit;

determining, by the controller, whether the sensed driving duty of the oil pump control unit is below a set reference value; and determining, by the controller, the electric oil pump rotor is in a worn out state, when the sensed driving duty of the oil pump control unit is below the set reference value.

2. The method of claim 1, wherein the diagnosing further includes: outputting, by the controller, a warning signal, when the driving duty of the oil pump control unit is below the set reference value.

3. The method of claim 2, wherein the determining whether the sensed driving duty of the oil pump control unit is below a set reference value determines whether the driving duty of the oil pump control unit is below a set driving duty region or not, and the outputting outputs the warning signal when the driving duty of the oil pump control unit is below the set driving duty region.

4. The method of claim 1, further comprising:

confirming, by the controller, whether it is possible to perform the diagnosing before the diagnosing sensing, wherein as a result of the confirming, when it is possible to perform the diagnosing, the sensing is performed.

5. The method of claim 4, wherein the confirming includes determining whether a voltage inputted into the oil pump control unit is included in a preset region, and the diagnosing is not performed when the voltage is not included in the preset region.

6. The method of claim 4, wherein, the confirming includes determining whether a temperature of an automatic transmission fluid is below a predetermined temperature, and the diagnosing is not performed when the temperature of the automatic transmission fluid is below the predetermined temperature.

7. The method of claim 4, wherein the confirming includes determining whether a temperature sensor for sensing a temperature of an automatic transmission fluid is operable, and the diagnosing is not performed when the temperature sensor is inoperable.

8. The method of claim 4, wherein the confirming includes determining whether the number of revolutions of the EOP is included in a set number of revolutions, and the diagnosing is not performed when the number of revolutions of the EOP is not included in the set number of revolutions.

9. The method of claim 4, wherein the confirming includes determining whether other diagnostic counts are generated in the oil pump control unit, and the diagnosing is not performed when other diagnostic counts are generated.

* * * * *